US005117507A

United States Patent [19]

Long

[11] Patent Number: 5,117,507

[45] Date of Patent: * Jun. 2, 1992

[54] LONG-SLEEVED GARMENT WITH INTEGRATED ANIMAL DESIGN AND PUPPET-LIKE SLEEVE

[76] Inventor: Marla M. Long, 1486 McTaggart Rd., Stow, Ohio 44224

[ * ] Notice: The portion of the term of this patent subsequent to Jan. 1, 2008 has been disclaimed.

[21] Appl. No.: 635,543

[22] Filed: Jan. 14, 1991

Related U.S. Application Data

[63] Continuation-in-part of Ser. No. 351,210, May 15, 1989, Pat. No. 4,980,929.

[51] Int. Cl.[5] ..... A41D 1/00

[52] U.S. Cl. ..... 2/158; 2/75; 2/125; 446/329

[58] Field of Search ..... 2/1, 75, 125, 158; 446/26, 28, 327, 328, 329; D2/79, 80, 81, 82, 84, 208, 209, 213, 214, 215, 216, 222

[56] References Cited

U.S. PATENT DOCUMENTS

| | | | |
|---|---|---|---|
| D. 99,368 | 4/1936 | Raimer | 3/26 |
| D. 99,369 | 4/1936 | Raimer | 3/26 |
| D. 107,184 | 11/1937 | Buffett | D2/215 |
| D. 217,654 | 5/1970 | Ryland | 446/329 |
| D. 268,222 | 3/1983 | Chen | 2/158 |
| 361,250 | 4/1887 | Wright | 2/125 |
| 1,092,047 | 3/1914 | Hertz | 2/158 |
| 1,183,792 | 5/1916 | Aron | 2/158 |
| 1,296,966 | 3/1919 | Kaufman | 2/158 |
| 2,323,136 | 6/1943 | Johanson | 2/158 |
| 2,677,130 | 5/1954 | O'Hayer | 2/75 |
| 2,795,896 | 6/1957 | Snyder | 446/329 |
| 3,226,849 | 1/1966 | Rosen | 446/329 |
| 3,308,479 | 3/1967 | Sesco | 446/327 |
| 3,447,165 | 6/1969 | Brosk | 446/327 |
| 4,244,142 | 1/1981 | Crawford | 446/329 |
| 4,280,292 | 7/1981 | Hills | 446/28 |
| 4,759,084 | 7/1988 | Madnick | 2/158 |
| 4,799,889 | 1/1989 | Yockey | 446/328 |
| 4,980,929 | 1/1991 | Long | 2/125 |

*Primary Examiner*—Werner H. Schroeder
*Assistant Examiner*—Diana L. Biefeld
*Attorney, Agent, or Firm*—Ronald P. Kananen

[57] ABSTRACT

A shirt-like garment having an upper body torso merging into a sleeve portion wherein a figure is applied to the torso portion and to the sleeve portion to appear as an integrated image. The sleeve preferably terminates in an puppet head at its distal end so that a wearer may insert a hand into the puppet head for manipulation as a convention puppet. The mouth of the puppet head is preferably formed with upper and lower inner mouth pieces defining a slot through which a hand of a wearer may extend free from the puppet head. When so extended, the puppet head will be fastened about the wrist of the wearer by suitable fasteners.

7 Claims, 4 Drawing Sheets 10
12
14
15
18
20
22
24
26
28
30
32
38
7
50
52a
52b
54a
54b
56
58

FIG. 6
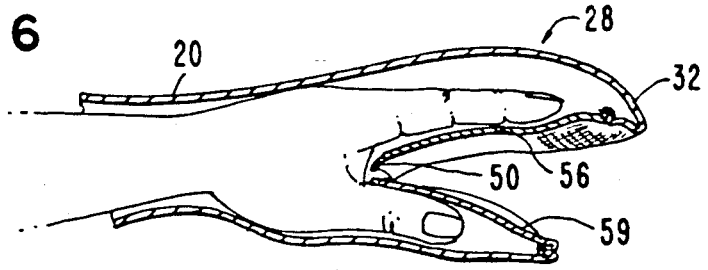
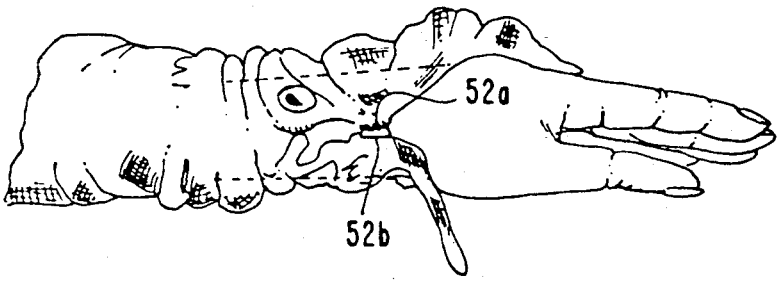
FIG. 7
FIG. 8
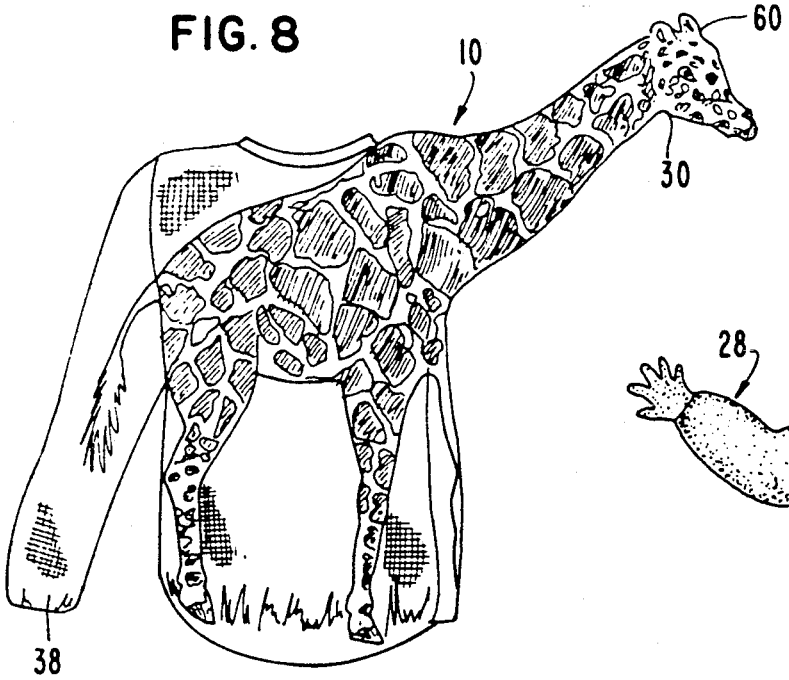
FIG. 9
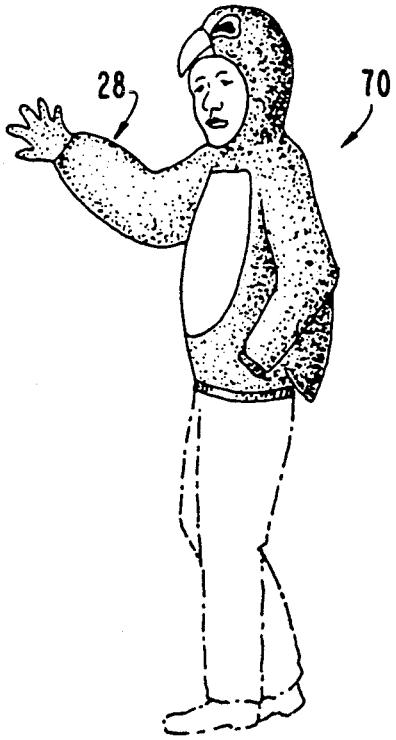

LONG-SLEEVED GARMENT WITH INTEGRATED ANIMAL DESIGN AND PUPPET-LIKE SLEEVE

CROSS-REFERENCE TO RELATED APPLICATION

This application is a continuation-in-part of U.S. patent application Ser. No. 351,210, filed May 15, 1989, now U.S. Pat. No. 4,980,929, issued Jan. 1, 1991.

BACKGROUND OF THE INVENTION

This invention relates to an article of clothing useful as a novelty item. More particularly, this invention relates to a long-sleeved garment having an animal design applied to the body of the garment and a sleeve terminating in a puppet-like figure. Still more particularly, this invention relates to a garment having a hand-accommodating sleeve end formed as a puppet head.

It is common and quite popular to imprint a design on the body of a garment such as a tee-shirt, blouse, shirt, and the like wherein the design appears on the body-girdling portion of the garment. For adults, such garments are popular for displaying products of adult interest, or resorts, and the like. For children, such designs often take the form of cartoon or television characters, or individually-created characters which are acceptable and recognizable to children. Chickens, dinosaurs, bears, and other animal characters are generally popular with children. Examples of such once-patented designs are found in U.S. Pat. No. Des. 99,369 and in U.S. Pat. No. Des. 99,368. Such designs are generally applied to short-sleeved garments. However, even when long-sleeved garments are produced, the design does not usually extend to a major portion of the sleeve.

On the other hand, puppet characters have been popular with children for many years. Regularly, puppet shows are held wherein the puppeteer uses a mitten-like structure formed as a puppet character which is manipulated to words and music. Television has regularly provided puppets to children which are appealing to their sense of fancy. An example of such a garment in the patent literature is found in U.S. Pat. No. 3,308,479, while U.S. Pat. No. 3,447,165 shows an illustrative example of a mitten and character combination.

Moreover, wholly aside from the designs and puppets discussed above, garment sleeves have taken a variety of shapes and forms for various purposes over the years. Certain sleeve ends have taken on a convertible character so that the hand of the wearer can be selectively covered or exposed. Such structures are functional in nature and not associated with a puppet-like character or as a part of the aesthetic design of the garment. Representative examples of such structures are shown in U.S. Pat. Nos. 361,250; 1,092,047; and 1,183,792. On the contrary, however, U.S. Pat. No. 2,323,136 shows a convertible mitten which in one embodiment may be used for silhouetting characters.

None of the noted art suggests or teaches a combination of a garment with a design integrated into the sleeve, wherein the sleeve end is formed as a part of the design character or is useful as a puppet. Thus, a primary object of this invention is to provide a garment of the type described comprising a long-sleeved upper torso garment having a hand-accommodating sleeve end and an animal design applied to the torso portion of the garment.

It is an additional object of the invention to provide a garment of the type described wherein the garment is in the form of a shirt, sweater, or blouse having long sleeves and a mitten-like attachment on one or both sleeves.

It is still another object of this invention to provide such a garment with an animal design arranged so that the head of animal extends down the sleeve of the garment and the body of the animal appears on the torso portion of the garment, a dinosaur, flamingo, or giraffe being representative of the types of creatures which are particularly suited for such integration with the garment because of their elongated neck structures.

It is another object of this invention to provide a garment with a sleeve terminating in a mitten-like sleeve end formed as the head of a hand-held puppet-like character, wherein the sleeve end is split transversely at a location spaced from the puppet-like sleeve end to permit a hand of the user to protrude from the slot so that the garment can be worn in a conventional manner with the hands of the wearer being free from envelopment by the garment.

It is still another object of the invention to provide a slotted garment of the type described immediately above, which is formed by pair of flaps, each having a portion attached along its perimeter to form a pouch that opens away from the cuff on the inside of the sleeve.

It is still another object of the invention to provide a slotted garment of the type described immediately above, which includes fasteners attached on the sides of the inner face of one pouch and on the outside edge of the other pouch, wherein the head of the encrypted animal forms a puppet mouth.

It is still another object of the invention to provide a slitted garment of the type described, which includes a ribbed cuff attached to the sides of the inner face of the pouches, wherein the head of the encrypted animal forms a puppet mouth.

These and other objects of the invention will become apparent from a written description of the invention which follows, taken in conjunction with the accompanying drawings.

BRIEF SUMMARY OF THE INVENTION

Directed to achieving the foregoing objects and overcoming problems in the prior art, the invention comprises an article of manufacture. The article includes an garment structurally adapted for being worn on the upper torso of a human, comprising a upper torso portion which includes at least one long sleeve secured thereto, the garment including a design imprinted on the garment so that a portion of the design is contained on the upper torso portion of the garment while an integrated portion of the design is applied to the sleeve. The upper torso portion is made from a front body piece and a back body piece suitably fastened, such as by sewing.

Preferably, the sleeve terminates in a mitten-like portion, such as a puppet head sleeve piece, which is formed as the head of an animal figure. The animal figure can thus be manipulated by the hand of the wearer when inserted into the mitten-like puppet portion. In a preferred embodiment, the terminal portion of the sleeve comprises a pair of flaps, such as upper and lower inner mouth pieces, secured about at least a portion of their perimeter to define a slot through which a hand of the user may exit when desired.

In an alternative embodiment, the terminal portion of the sleeve comprises a pair of flaps, such as upper and lower inner mouth pieces, secured about their perimeter by a ribbed cuff to define a slot through which the hand of the user may exit when desired.

The animal design which is integrated between the upper torso portion of the document may take any of a number of suitable forms. However, long-necked animals such as flamingos, giraffes, snakes, camels, and dinosaurs, and a trunked animal such as an elephant are particularly suited.

The upper torso garment may take a number of forms, such as an open neck garment or a hooded garment. If desired, both sleeves can be configured as described above, although one sleeve will usually be a regular sleeve piece.

Moreover, the animal graphic is not required to extend continuously up the arm and/or on the torso of the garment but may be located solely at the terminal portion of the sleeve.

These and other features of the invention will become further apparent from the written description of the invention which follows.

BRIEF DESCRIPTION OF THE DRAWINGS

In the drawings:

FIG. 6 is a fragmentary partial sectional longitudinal view of the distal end of the sleeve with the hand of the wearer in its puppet-manipulating position;

FIG. 7 is a sectional view taken along line 7—7 of FIG. 3;

FIG. 8 is an illustrative view of another animal character, wherein the puppet head is three-dimensionally sculptured; and FIG. 9 is an illustrative view of still another animal character in an alternative illustrative form of the garment, i.e. a hooded pullover;

DETAILED DESCRIPTION OF THE PREFERRED EMBODIMENTS

Figures 1, 2, 3, 4, 5:
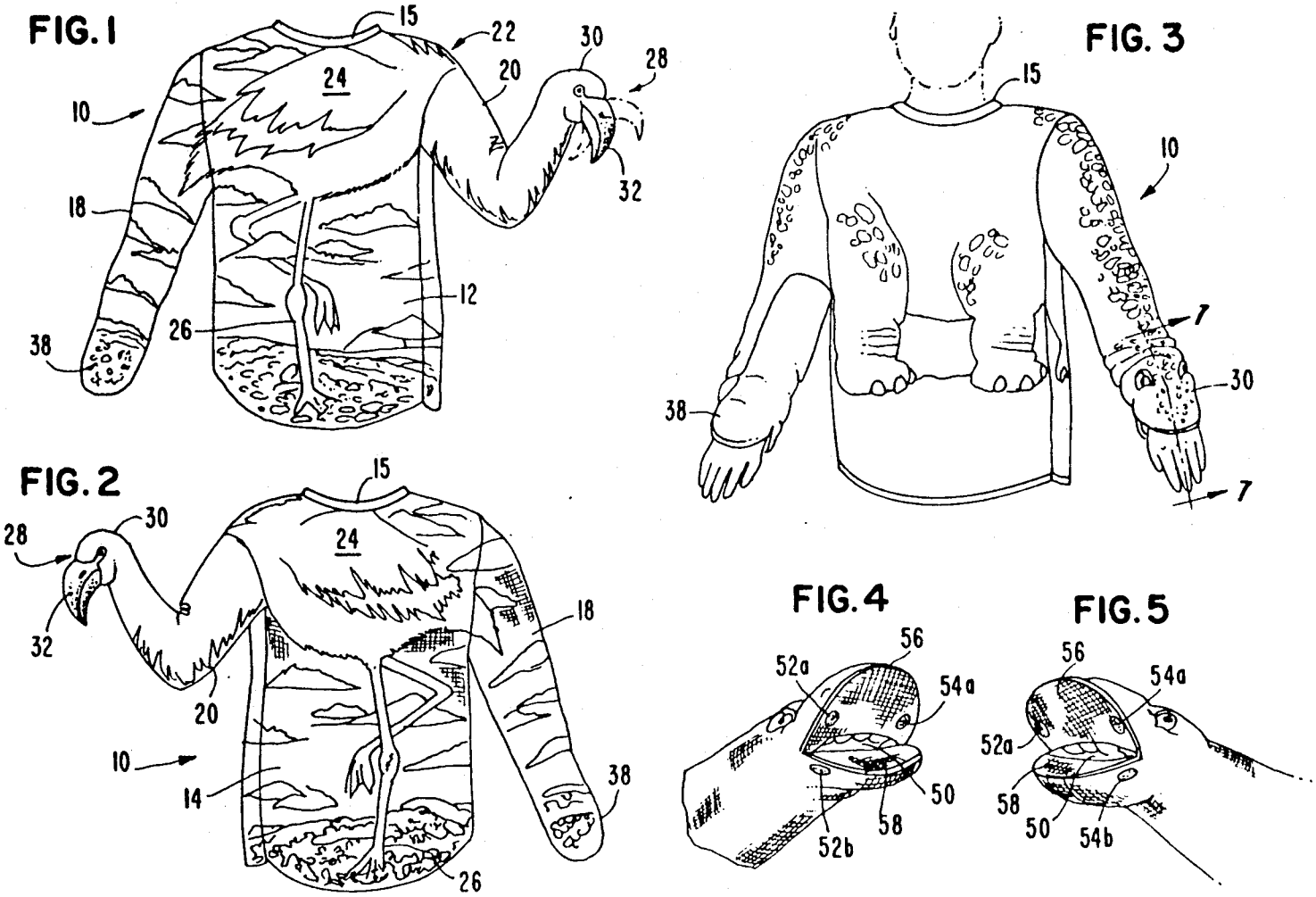
FIG. 1 is a front version of the upper torso garment according to the invention showing a flamingo design.
FIG. 2 is a rear version of the upper torso garment according to the invention as shown in FIG. 1.
FIG. 3 is a frontal view of a garment such as in FIGS. 1 and 2 with a different animal design and showing the puppet head at the terminal end of the sleeve in a retracted position so that the hand of the wearer may extend through a slit in the end.
FIG. 4 is a perspective view of the puppet head construction at the terminal end of a sleeve with the puppet mouth in an open position and securing tabs unlatched.
FIG. 5 is another view of the puppet head at the terminal head of the sleeve showing the flaps forming a slot, i.e. an arm hole, through which a hand of the wearer may extend.

A representative example of the garment according to the invention is shown in FIGS. 1 and 2 at the reference numeral 10. The garment 10 is in the form of an upper torso tee-shirt having an upper torso portion 12 structurally adapted and sized to be worn on the upper body of a person, whether an adult or a child. The upper torso portion 12 is made from a front body piece 13 and a back body piece 14 (see FIG. 2) sewn or otherwise suitably secured. The garment 10 includes a neck portion 15 through which the neck and head of a wearer extend when the garment is worn, and a shirttail or bottom portion 16 opposite from the neck portion 15. The garment 10 further includes a right sleeve 18, generally referred to as a puppet head sleeve piece, and a left sleeve 20, generally referred to as a regular sleeve piece sewn to the garment in a conventional manner.

A design 22 is applied to the garment 10 in a conventional manner such as by silk screening, hand painting, or the like in such a way that the design is integrated between the upper torso portion 12 of the garment 10 and at least the left sleeve portion 20. In the embodiment illustrated in FIGS. 1 and 2, the design is that of a flamingo having its body portion 24 and legs 26 applied to the upper torso portion 12 of the garment 10 and its neck and head portion applied to the sleeve 20. The right sleeve 18 may also be integrated into the design.

Preferably, the sleeve 20 terminates at its distal end 28 in a puppet-head-like portion 30 representing a head of a flamingo. The garment 10 and in particular the sleeve 20 are thus adapted so that a hand of the wearer may be enclosed by the puppet-like-head portion 30 of the sleeve 20. When the hand of the wearer is so enclosed within the head 30 of the sleeve 20, the head 30 may be manipulated in a puppet-like fashion as is conventional in puppeteering. The particular puppet-head portion 30 may include additional structure such as a beak 32 for the flamingo, or as shown in FIG. 8, with ears 34 for a giraffe 36.

Structurally, the sleeve 20 is preferably slightly longer than the sleeve 18, although the sleeves may also be approximately the same lengths. It may also be noted from FIG. 2 which is a view of the garment 10 from the side opposite to that shown in FIG. 1 that the design is continued on that side as well. With an image of the neck and head of the animal applied to the sleeve 20, the animal image is seen "in the round", and also permits the garment to be worn to allow manipulation of the puppet head by either hand. Thus, the "front" may act as the "back" and vice versa.

In use, a wearer dons the garment in a conventional manner so that a right arm and hand are nestled within the right sleeve 18 and a left arm and hand are nestled within the left sleeve 20. The left hand is inserted into and within the head portion 30 of the left sleeve so that the head of the flamingo may be manipulated while the garment is being worn. Such as garment has utility as a novelty item, and as a prop for staged shows for or by children acting out puppet themes and motifs.

The right sleeve 18 may terminate in a cuff-like portion 38 as shown in FIGS. 1 and 2 which may enclose the right hand, or preferably the right distal portion 38 is open to permit the right hand to protrude from the sleeve when desired, as best seen in FIG. 3. Preferably, the puppet head 30 will extend from the lower portion of the sleeve 20 at its distal end in one continuous piece of material, although separate pieces of material appropriately sewn together, or otherwise fastened will also be suitable. The specific shape of the puppet head extension will be determined by the type of animal depicted on the particular shirt. Modifications such as slightly padded areas, extra seams, and separate ear pieces will be or might be needed to give a proper shape to certain of the pet heads.

As best seen in FIG. 3, when not in use, the puppet head sleeve 20 can be retracted by pushing the sleeve back up onto the forearm of the wearer, so that the hand of the wearer is exposed. The hand of the wearer will slip through a mouth hole 50 at the back of the formed mouth of the puppet head 30. The puppet head sleeve can then be secured in place around the wrist of the wearer by fastening a suitable fastener such as a snap button, or preferably by VELCRO brand tabs 52*a*, 54*a* located at the inner side of the upper mouth piece 56 and at the outer edge of the lower mouth piece 58 at the tabs 52*b*, 54*b*. This retractable design allows the wearer to keep the continuity of the animal design while not using the puppet head.

FIG. 3 is also representative of another design applied to the garment 10. As shown in FIG. 3, the design is that of a dinosaur-type creature having its head at the distal end of the left sleeve and its tail on the right sleeve 18, while its body is located on the torso portion of the garment 10.

FIGS. 4 and 5 depict in greater detail the internal mouth structure of the puppet head as previously described.

FIGS. 6 and 7 illustrate respectively the use of the hand inside the puppet, while FIG. 7 shows a cross sectional view taken along line 7—7 of FIG. 3 showing the hand extended from one sleeve.

FIG. 8, as previously mentioned, shows still another representative figure, i.e. that of a giraffe, showing its antlers 60 as a representative three-dimensional head configuration.

Finally, FIG. 9 shows a hooded version 70 of the pullover as an alternative embodiment when the hand puppet 28 is formed consistent with the character. In FIG. 9, a penguin is shown as an example of hooded characters.

Alternatively, the right sleeve 18 may terminate in a ribbed cuff 71 as set forth in FIGS. 10–15. In this embodiment, the terminal portion of the sleeve comprises a pair of flaps, such as outside upper and lower mouth pieces 72, secured about their perimeter by the ribbed cuff 71. An inside lower mouth piece 73 is sewn to the cuff 71 and to the upper outer mouth piece 72, while an inside upper mouth piece 74 is similarly sewn to the cuff 71 and to the outside upper mouth piece. The ribbed cuff 71 replaces the mouth hole 50 at the back of the formed head 30 thereby securing the sleeve at the wrist of the wearer without the need of the snap buttons or VELCRO brand tabs. The puppet head sleeve 20 can then be retracted but pushing the ribbed cuff 71 back up onto the forearm of the wearer so that the hand of the wearer is exposed.

Figure 10:
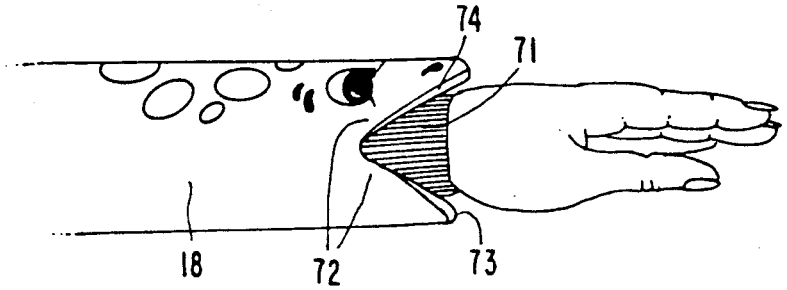
FIG. 10 is a sectional view taken along line 7—7 of FIG. 3 showing an alternative embodiment of a ribbed cuff attached to a terminal portion of the sleeve through which a hand of the wearer may extend.
Figure 11:
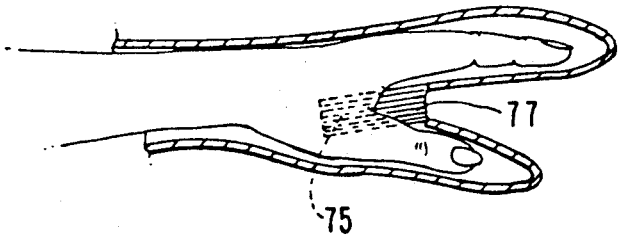
FIG. 11 is a fragmentary partial sectional longitudinal view of the distal end of the sleeve of FIG. 10 with the hand of the wearer in its puppet-manipulating position.

FIG. 11 is a side cross-sectional view taken along line 7—7 of FIG. 3 showing the hand extending from one sleeve utilizing the alternative ribbed cuff 71 as in FIG. 10. FIG. 11 shows the use of the hand inside the puppet with an alternative ribbed cuff insert 75, as seen from the inside. Preferably a continuous seam 77 attaches the ruffed cuff 75 to the inside mouth piece 73.

Figure 12:
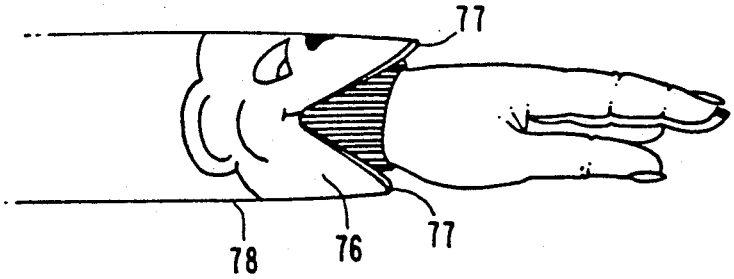
FIG. 12 is a another sectional view taken along line 7—7 of FIG. 3 showing the alternative embodiment of the ribbed cuff with the graphic design located solely on the terminal end of the sleeve.

FIG. 12 is a second sectional view taken along line 7—7 of FIG. 3 showing a ribbed cuff insert with the graphic design 76 on the garment located solely at the terminal end of the sleeve 18. Thus, the graph does not necessarily extend continuously up the arm and/or on the torso of the garment. A continuous seam 77 is used, as in FIG. 4, while a continuous sleeve seem 79 is preferably used to sew the garment together.

Figure 13:
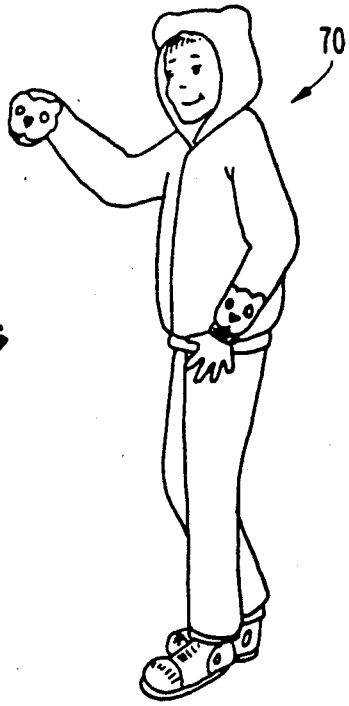
FIG. 13 is an illustrative view of an animal character head located solely at the terminal end of the sleeve of the garment.

FIG. 13 shows a hooded version 70 of the pullover as an alternative embodiment when the hand puppet 28 is formed solely at the terminal end of the sleeve as in FIG. 12, for example.

Figure 14A:
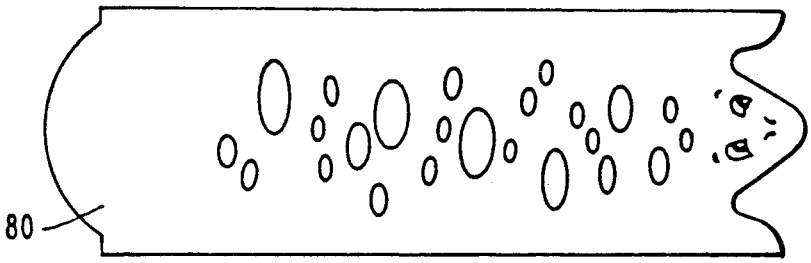
FIG. 14 shows in FIGS. 14A to 14D the flat pattern pieces for the upper and lower mouth pieces and the ribbed cuff of the terminal portion of the sleeve.
Figure 14B:
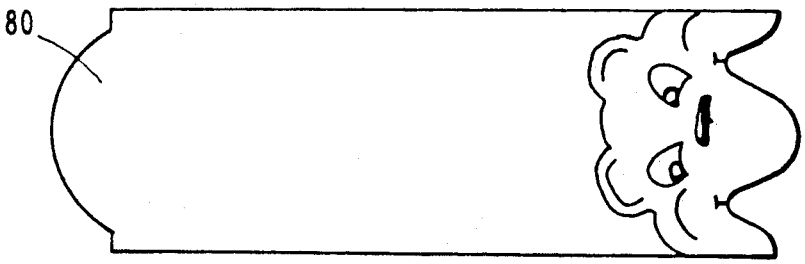
Figure 14C:
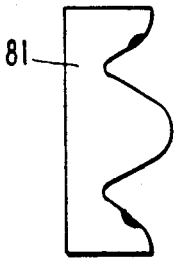
Figure 14D:
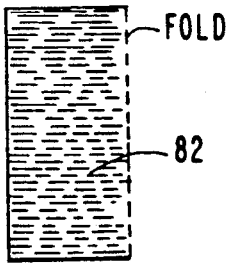

FIGS. 14A, 14B and 14C show the flat pattern pieces for the upper and lower mouth pieces 72 and the ribbed cuff 71 of the terminal portion of the sleeve 18 while a flat pattern piece 80 is provided for the upper and lower mouth piece 72 which is also the sleeve piece. Another flat pattern piece 71 is provided for the inside upper and lower mouth pieces 73, 74. A third flat pattern piece 82 is provided for the ribbed cuff. Thus, the sleeve can be sewn with a minimum number of pieces.

Figure 15:
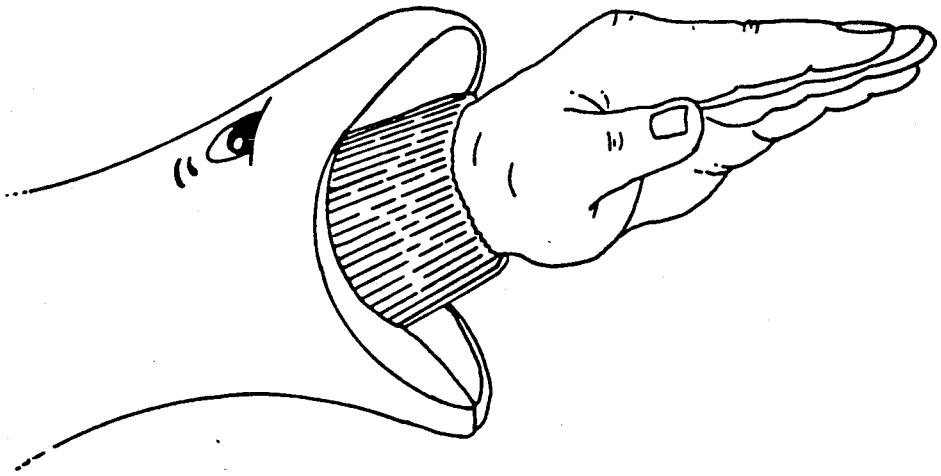
FIG. 15 illustrates the continuous seam through the sleeve, inner mouth pieces and ribbed cuff of the alternative terminal end of the sleeve.

FIG. 15 illustrates the continuous seam through the sleeve, inner mouth pieces and ribbed cuff of the alternative terminal end of the sleeve.

Thus, a shirt design having a number of unique features is shown and described. The shirt can be manufactured with a minimum number of pieces, i.e. a regular front body piece 13; a back body piece 14, a regular sleeve piece 18, a puppet head sleeve piece 20, an upper inner mouth piece 56, and a lower inner mouth piece 58 as have been described.

While this invention has been described in conjunction with a specific embodiment, therefore, it is evident that many alternatives, modifications, and variations will be apparent to those skilled in the art. Accordingly, it is intended to embrace all alternatives, modifications, and variations that fall within the scope of the appended claims.

What is claimed is:

1. An article of manufacture, comprising:

a garment having a sleeve portion having an artistic figure placed thereon so that a mouth of said figure appears at an opening in said sleeve, said opening being defined at least in part by a ribbed cuff secured to a portion of said sleeve and outside upper and lower mouth pieces, an inside lower mouth piece secured to said ribbed cuff, and an inside upper mouth piece secured to said ribbed cuff.

2. The article as set forth in claim 1, wherein a continuous seam secures said ribbed cuff to said inside mouth piece.

3. The article as set forth in claim 1, wherein a continuous seam secures said upper and lower mouth piece to the outside upper and lower mouth piece.

4. The article as set forth in claim 3, wherein said article is made from a flat pattern piece which defines the outside upper and lower mouth piece and said sleeve, said artistic figure appearing on said flat pattern piece; a second flat pattern piece which defines the inside upper and lower mouth piece, and a third flat pattern piece which defines said ribbed cuff.

5. An article of manufacture comprising:

a shirt-like garment having an upper body torso portion merging into a sleeve portion, said sleeve portion having applied thereto an artistic figure, wherein said sleeve portion includes a puppet head sleeve piece at its distal end, whereupon insertion of a hand of a wearer into said puppet head sleeve piece permits its manipulation in a manner similar to a conventional puppet; and wherein said sleeve portion includes a ribbed cuff.

6. An article of manufacture comprising:

a shirt-like garment having an upper body torso portion merging into a sleeve portion, said sleeve portion having applied thereto an artistic figure, wherein said sleeve portion includes a puppet head sleeve piece at its distal end, whereupon insertion of a hand of a wearer into said puppet head sleeve piece permits its manipulation in a manner similar to a conventional puppet; and wherein said puppet head sleeve piece includes an upper inner mouth piece and a lower inner mouth piece, together defining a slot therebetween so that a hand of a wearer can extend through said slot when not inserted into said puppet head sleeve piece.

7. The article of manufacture as set forth in claim 6, further including a continuous seam for securing said upper and lower inner mouth pieces.

* * * * *